US008689885B2

(12) United States Patent
Maldonado

(10) Patent No.: US 8,689,885 B2
(45) Date of Patent: Apr. 8, 2014

(54) BI-DIRECTIONAL FLAPPER/SEALING MECHANISM AND TECHNIQUE

(75) Inventor: Ricardo R. Maldonado, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 284 days.

(21) Appl. No.: 13/046,728

(22) Filed: Mar. 12, 2011

(65) Prior Publication Data

US 2011/0232916 A1 Sep. 29, 2011

(30) Foreign Application Priority Data

Mar. 25, 2010 (WO) ..... PCT/US2010/028574

(51) Int. Cl.
*E21B 34/06* (2006.01)

(52) U.S. Cl.
USPC ..... 166/373; 166/80.1; 166/332.8

(58) Field of Classification Search
USPC ..... 166/373, 80.1, 332.8
See application file for complete search history.

(56) References Cited

U.S. PATENT DOCUMENTS 2,912,216 A * 11/1959 Conrad ..... 251/100
4,574,889 A 3/1986 Pringle
4,606,416 A 8/1986 Knighton et al.
4,698,631 A 10/1987 Kelly, Jr. et al.
4,768,594 A 9/1988 Akkerman
5,101,907 A 4/1992 Schultz et al.
5,127,477 A 7/1992 Schultz
5,249,630 A 10/1993 Meaders et al.
5,279,363 A 1/1994 Schultz et al.
5,531,270 A 7/1996 Fletcher
5,971,072 A 10/1999 Huber et al.
6,017,198 A 1/2000 Traylor et al.
6,041,864 A 3/2000 Patel et al.
6,142,226 A 11/2000 Vick
6,152,232 A 11/2000 Webb et al.
6,167,974 B1 1/2001 Webb
6,199,629 B1 3/2001 Shirk et al.
6,209,663 B1 4/2001 Hosie
6,328,109 B1 * 12/2001 Pringle et al. ..... 166/373
6,343,649 B1 2/2002 Beck et al.
6,343,658 B2 2/2002 Webb
6,359,569 B2 3/2002 Beck et al.

(Continued)

OTHER PUBLICATIONS

International Search Report and Written Opinion issued Jan. 20, 2011 for International Patent Application Serial No. PCT/US2010/28574, 10 pages.

(Continued)

*Primary Examiner* — Yong-Suk (Philip) Ro
(74) *Attorney, Agent, or Firm* — Smith IP Services, P.C.

(57) ABSTRACT

An isolation valve can include a pivot connecting a closure member to an actuator member which displaces when the isolation valve is actuated between open and closed configurations, whereby the pivot displaces with the actuator member. Another isolation valve can include a pivot connecting a closure member to an actuator member which displaces when the isolation valve is actuated between open and closed configurations, and a profile formed in the isolation valve. The profile biases the closure member from an open position to a closed position when the isolation valve is actuated from the open configuration to the closed configuration. A method of actuating an isolation valve includes actuating the isolation valve between open and closed configurations, and wherein actuating the isolation valve comprises simultaneously displacing an actuator member, a closure member, and a pivot which pivotably connects the closure member to the actuator member.

16 Claims, 3 Drawing Sheets

(56) References Cited

U.S. PATENT DOCUMENTS

| | | | | |
|---|---|---|---|---|
| 6,419,022 | B1 | 7/2002 | Jernigan et al. | |
| 6,557,637 | B1 | 5/2003 | Dore et al. | |
| 6,619,388 | B2 | 9/2003 | Dietz et al. | |
| 6,684,950 | B2 | 2/2004 | Patel | |
| 6,719,057 | B2 | 4/2004 | Johansen | |
| 6,957,703 | B2 | 10/2005 | Trott et al. | |
| 6,962,215 | B2 | 11/2005 | Curtis et al. | |
| 6,988,556 | B2 | 1/2006 | Vick, Jr. | |
| 7,152,688 | B2 * | 12/2006 | Richards | 166/386 |
| 7,178,600 | B2 * | 2/2007 | Luke et al. | 166/373 |
| 7,562,712 | B2 | 7/2009 | Cho et al. | |
| 7,597,151 | B2 | 10/2009 | Curtis et al. | |
| 7,730,953 | B2 | 6/2010 | Casciaro | |
| 2001/0013411 | A1 | 8/2001 | Beck et al. | |
| 2003/0019622 | A1 | 1/2003 | Goodson | |
| 2003/0029611 | A1 | 2/2003 | Owens | |
| 2003/0098157 | A1 | 5/2003 | Hales et al. | |
| 2003/0131986 | A1 | 7/2003 | Schultz et al. | |
| 2003/0192695 | A1 | 10/2003 | Dillenbeck et al. | |
| 2004/0129424 | A1 | 7/2004 | Hosie et al. | |
| 2004/0251032 | A1 | 12/2004 | Luke et al. | |
| 2004/0256113 | A1 | 12/2004 | LoGiudice et al. | |
| 2005/0039921 | A1 | 2/2005 | Schultz et al. | |
| 2005/0194182 | A1 | 9/2005 | Rodney et al. | |
| 2005/0230118 | A1 | 10/2005 | Noske | |
| 2006/0157255 | A1 | 7/2006 | Smith | |
| 2007/0012457 | A1 | 1/2007 | Curtis et al. | |
| 2007/0034371 | A1 | 2/2007 | Moyes | |
| 2007/0295504 | A1 | 12/2007 | Patel | |
| 2008/0135235 | A1 | 6/2008 | McCalvin | |
| 2009/0050373 | A1 | 2/2009 | Loretz | |
| 2009/0272539 | A1 | 11/2009 | Lloyd et al. | |
| 2010/0212891 | A1 | 8/2010 | Stewart et al. | |
| 2011/0232917 | A1 | 9/2011 | Skinner et al. | |

OTHER PUBLICATIONS

International Search Report and Written Opinion issued Mar. 17, 2011 for International Patent Application Serial No. PCT/US2010/28576, 10 pages.
International Preliminary Report on Patentability issued Oct. 4, 2012 for US PCT Patent Application No. PCT/US2010/028574, 6 pages.
International Preliminary Report on Patentability issued Oct. 4, 2012 for US PCT Patent Application No. PCT/US2010/028576, 6 pages.
International Search Report with Written Opinion issued Feb. 28, 2012 for PCT Patent Application No. PCT/US11/042836, 9 pages.
Halliburton; "Capilarry Deliquification Safety System", H06034, dated Jan. 2011, 2 pages.
Halliburton; "DepthStar® Tubing-Retrievable Safety Valve", H06191, dated May 2008, 4 pages.
Halliburton; "Quick-Trip® Valve", online product information, dated Jun. 8, 2012, 1 page.
Halliburton; "Tubing-Retrievable Subsurface Safety Valves", product presentation, dated Jul. 2008, 27 pages.
Halliburton; "DepthStar® Tubing-Retrievable Safety Valve", product presentation, dated Nov. 2009, 9 pages.
International Preliminary Report on Patentability and Written Opinion issued Jan. 24, 2008 for International Patent Application No. PCT/US06/023947, 6 pages.
PES; "Model DV Dual Control Line Operated Drill Through Lubricator Valve", company document, dated Jul. 27, 2001, 6 pages.
Weatherford, "A Year of Milestones for Your Company", annual report, dated 2002, 7 pages.
Office Action issued Mar. 1, 2007 for U.S. Appl. No. 11/180,140, 9 pages.
Office Action issued Sep. 17, 2007 for U.S. Appl. No. 11/180,140, 8 pages.
Office Action issued Sep. 9, 2008 for U.S. Appl. No. 11/180,140, 12 pages.
Office Action issued Oct. 27, 2008 for U.S. Appl. No. 11/180,140, 11 pages.
Office Action issued Feb. 26, 2008 for U.S. Appl. No. 11/180,140, 7 pages.
Halliburton; "Quick Trip Valve", article H02856R, dated Apr. 2002, 2 pages.
Weatherford; "Underbalanced Drilling: Undeniable Success", product article, dated Mar. 2002, 1 page.
Weatherford; "Products and Services Catalog", brochure # 01.01, dated 2002, 3 pages.
Office Action issued Jul. 10, 2013 for U.S. Appl. No. 13/046,740, 27 pages.
Office Action issued Nov. 7, 2012 for U.S. Appl. No. 13/490,936, 14 pages.
Office Action issued Feb. 7, 2013 for U.S. Appl. No. 13/046,730, 20 pages.
Office Action issued Apr. 15, 2013 for U.S. Appl. No. 13/490,936, 38 pages.
Office Action issued Aug. 28, 2013 for U.S. Appl. No. 13/490,936, 10 pages.
Office Action issued Oct. 23, 2013 for U.S. Appl. No. 13/046,730, 18 pages.
Office Action issued Nov. 15, 2013 for U.S. Appl. No. 13/490,936, 15 pages.

* cited by examiner

BI-DIRECTIONAL FLAPPER/SEALING MECHANISM AND TECHNIQUE

CROSS-REFERENCE TO RELATED APPLICATION

This application claims the benefit under 35 USC §119 of the filing date of International Application Serial No. PCT/US10/28574, filed Mar. 25, 2010. The entire disclosure of this prior application is incorporated herein by this reference.

BACKGROUND

The present disclosure relates generally to equipment utilized and operations performed in conjunction with a subterranean well and, in an embodiment described herein, more particularly provides a bi-directional flapper/sealing mechanism and associated technique.

It is sometimes desirable to isolate one section of a wellbore from another. For example, it may be useful to isolate an uncased section of a wellbore from an upper section of the wellbore while a drill string is tripped out of, and into, the wellbore. In this manner, swab and surge effects will not damage the uncased section, fluids will not be produced from a formation into the wellbore, etc.

Isolation valves have been used for these purposes, and others, in the past. However, the construction of prior isolation valves has not always been entirely satisfactory, in some instances because of operational problems, unreliability, etc.

Therefore, it will be appreciated that improvements are needed in the art of constructing isolation valves.

DETAILED DESCRIPTION

Figure 1:
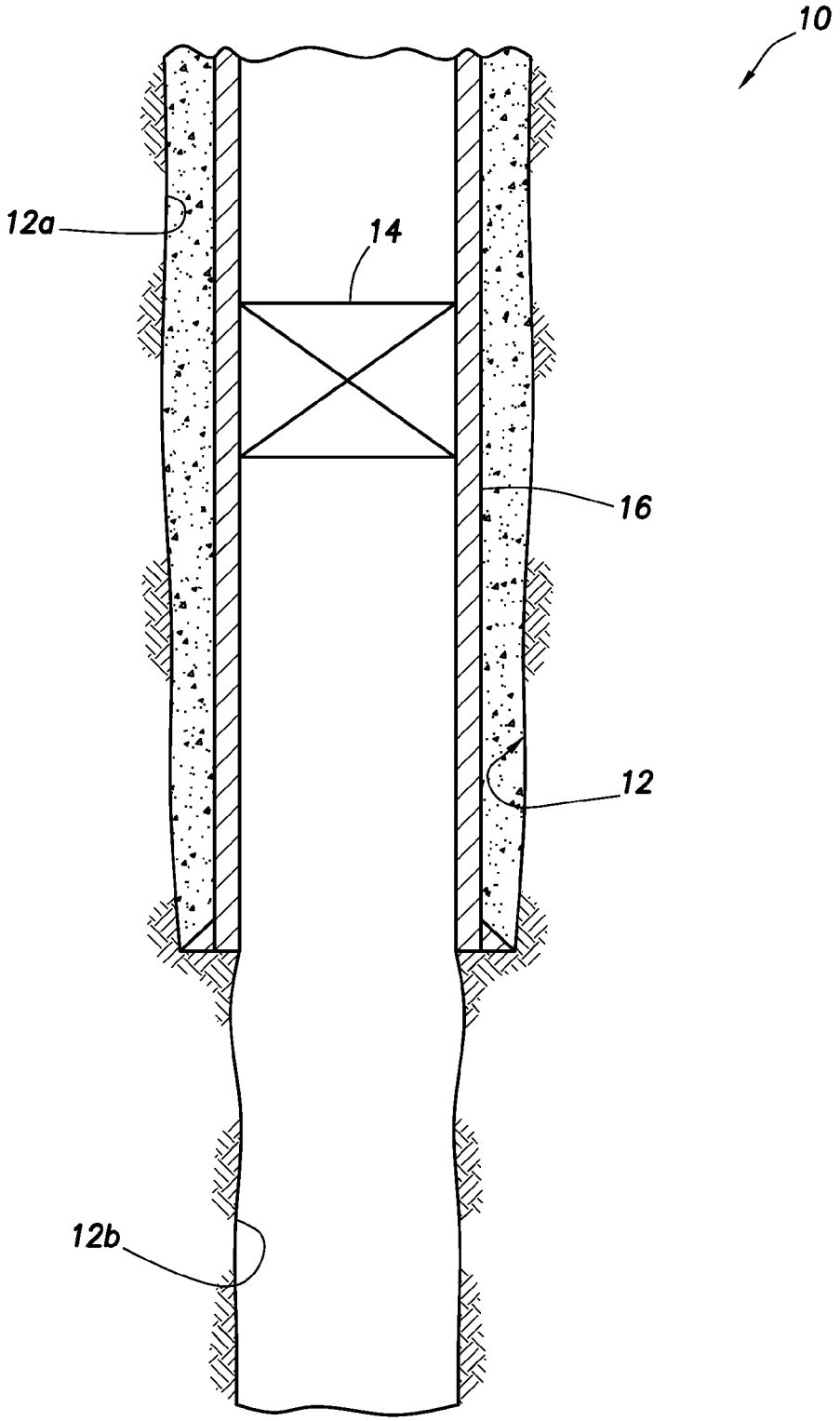
FIG. 1 is a schematic cross-sectional view of a well system and associated method which embody principles of the present disclosure.

Representatively illustrated in FIG. 1 are a well system 10 and an associated method which embody principles of the present disclosure. In the well system 10 as depicted in FIG. 1, an upper section 12*a* of a wellbore 12 is cased, and a lower section 12*b* of the wellbore is uncased (also known as open hole).

An isolation valve 14 is interconnected in a tubular string 16 (such as casing) which lines the upper section 12*a*. The isolation valve 14 could be interconnected in the tubular string 16 as it is installed in the wellbore 12, or the isolation valve could be secured in the tubular string after the tubular string is installed in the wellbore (for example, by interconnecting the isolation valve in a liner string which is secured to the casing by a liner hanger, etc.)

Note that the term "casing" is meant to encompass any protective wellbore lining. Casing can include tubular materials known as tubing, liner, casing, etc. Casing can be continuous or segmented, and can be formed in situ. Casing can have lines (such as electrical, hydraulic, fiber optic, etc. lines) in a sidewall thereof, or on an interior or exterior thereof, for actuation of the isolation valve 14.

The isolation valve 14 in the system 10 selectively isolates the uncased section 12*b* from the cased section 12*a*, for example, while a drill string (not shown) is tripped out of, and into, the wellbore 12 in a drilling operation. However, this is only one possible use for the isolation valve 14.

Another possible use would be isolating a completed wellbore section from a wellbore section above a production packer in a completion operation (e.g., in order to prevent loss of completion fluids and damage to a completed interval, etc.). Thus, it should be clearly understood that the well system 10 depicted in FIG. 1 is only one example of a variety of possible uses for the isolation valve 14, and the principles of the present disclosure are not limited to any particular details of the well system 10 and its associated method.

Figure 2:
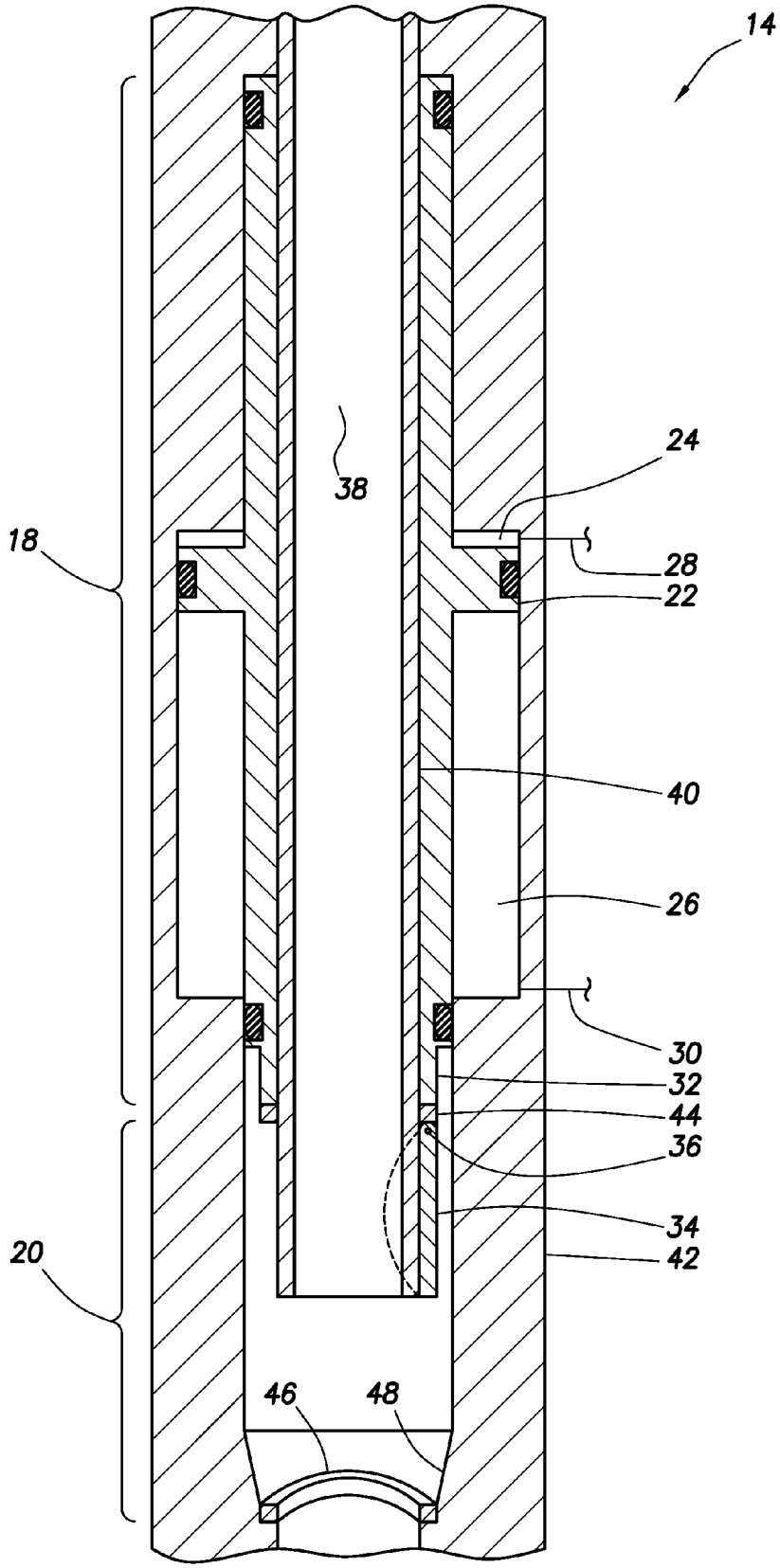
FIG. 2 is a schematic cross-sectional view of an isolation valve embodying principles of the present disclosure, the isolation valve being usable in the system and method of FIG. 1, and the isolation valve being depicted in an open configuration in FIG. 2.

Referring additionally now to FIG. 2, a schematic cross-sectional view of the isolation valve 14 in an open configuration is representatively illustrated. The isolation valve 14 can be used in the well system 10 and method of FIG. 1, or the isolation valve can be used in other systems and methods, in keeping with the principles of this disclosure.

The isolation valve 14 as depicted in FIG. 2 includes an actuator 18 and a closure assembly 20. The actuator 18 includes an annular piston 22 which separates upper and lower annular chambers 24, 26 connected to pressure sources (not shown) via respective lines 28, 30. A pressure differential is applied to the piston 22 via the chambers 24, 26 and lines 28, 30 to thereby displace the piston between its upper and lower positions.

Note that the piston 22 is not necessarily annular-shaped. Other types of pistons (such as, concentric or rod pistons, etc.) may be used in keeping with the principles of this disclosure.

Figure 3:
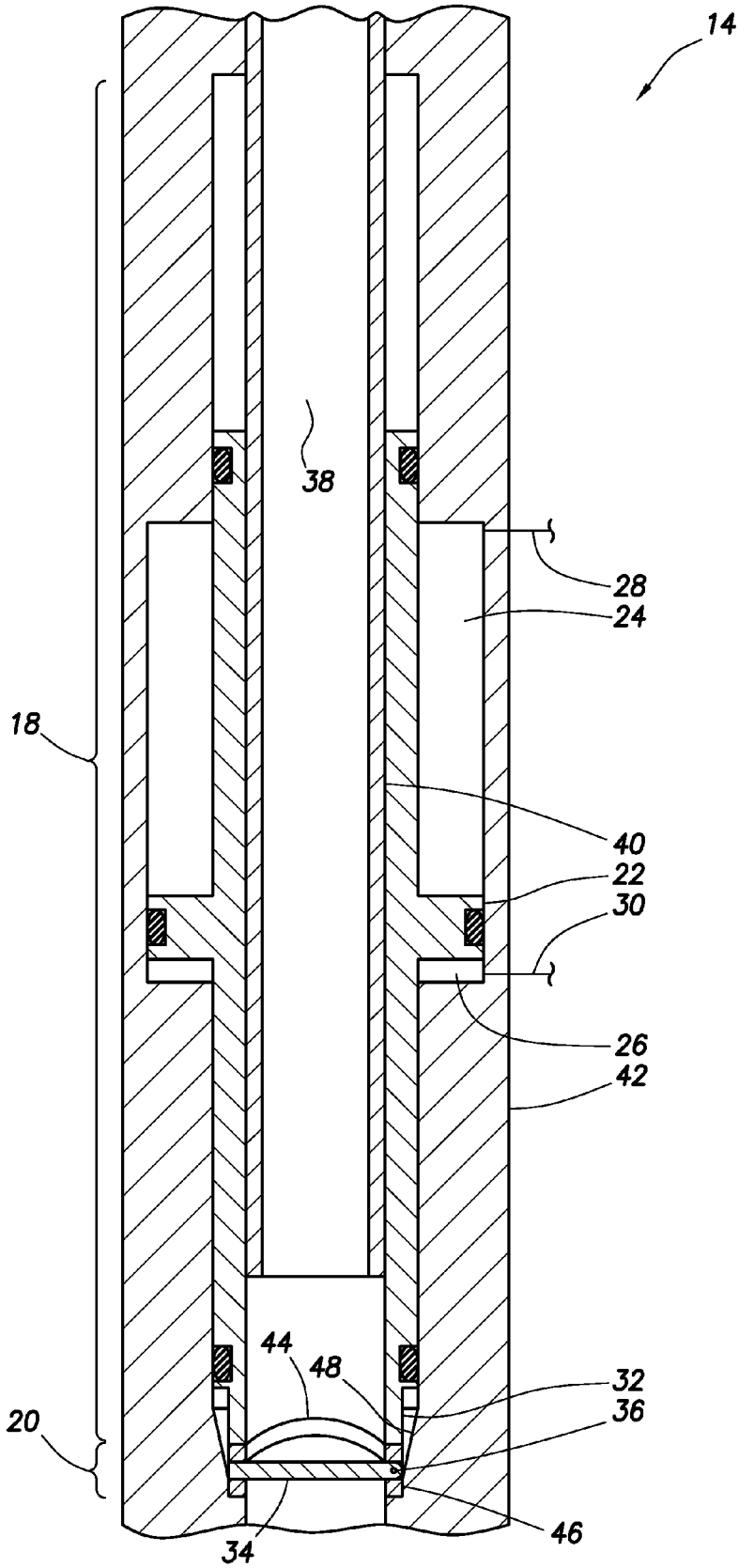
FIG. 3 is a schematic cross-sectional view of the isolation valve of FIG. 2, the isolation valve being depicted in a closed configuration in FIG. 3.

In FIG. 2, the piston 22 has been displaced to its upper position in response to a pressure differential from the lower chamber 26 to the upper chamber 24. In FIG. 3, the piston 22 has been displaced to its lower position in response to a pressure differential from the upper chamber 24 to the lower chamber 26. Any means of controlling the application of the pressure differentials between the chambers 24, 26, and thereby actuating the actuator 18, may be used in keeping with the principles of this disclosure.

A tubular actuator member 32 extends downwardly from the piston 22. It is not necessary for the member 32 to be tubular, or for the member to be directly connected to (or to be formed as part of) the piston 22, or for the member to be displaced by the piston. However, the member 32 preferably does displace when the isolation valve 14 is actuated between its open and closed configurations.

The closure assembly 20 includes a closure member 34 which is pivotably connected to the actuator member 32 by a pivot 36. In the open configuration depicted in FIG. 2, the closure member 34 is maintained in an open position (i.e., so that it does not obstruct flow through a passage 38 extending longitudinally through the isolation valve 14) by a generally tubular mandrel 40. In the closed configuration depicted in FIG. 3, the closure member 34 is pivoted to a closed position (i.e., so that flow through the passage 38 is prevented by the closure member).

In the examples of FIGS. 2 & 3, the closure member 34 comprises a curved flapper. Preferably, the closure member 34 conforms to an annular space formed radially between the mandrel 40 and an outer housing 42 of the isolation valve 14. However, other shapes of closure members may be used in the isolation valve 14 in keeping with the principles of this disclosure.

Note that, in the closed configuration depicted in FIG. 3, the closure member 34 is compressed between, and thereby sealingly engages, an upper seat 44 carried on the actuator member 32, and a lower seat 46 disposed in the housing 42. The seats 44, 46 are curved to complementarily engage the closure member 34. The seats 44, 46 may be annularly or circumferentially shaped as seen in FIGS. 2 and 3.

The pressure differential from the upper chamber 24 to the lower chamber 26 biases the piston 22 downwardly to thereby compress the closure member 34 between the seats 44, 46. In this manner, both upward and downward flow through the passage 38 is preferably prevented in the closed configuration.

However, once the closure member 34 is in its closed position as depicted in FIG. 3, a pressure differential applied across the closure member from an upper side thereof will bias the closure member downwardly to sealingly engage the lower seat 46, and a pressure differential applied across the closure member from a lower side thereof will bias the closure member upwardly to sealingly engage the upper seat 44, and so it may not be necessary to maintain the pressure differential from the chamber 24 to the chamber 26 in order to continue to prevent flow through the passage 38.

It should be clearly understood that the seats 44, 46 are not necessarily positioned as depicted in FIG. 3. For example, the upper seat 44 could instead be secured to a lower end of the mandrel 40, in which case a pressure differential from below could bias the closure member 34 into sealing contact with the upper seat, and a pressure differential from the upper chamber 24 to the lower chamber 26 would not necessarily be used to compress the closure member between the seats 44, 46.

A profile 48 is preferably formed in the housing 42, and is appropriately shaped, so that it urges the closure member 34 toward its closed position (i.e., pivoting radially inward) when the piston 22 and actuator member 32 displace the closure member downward. The profile 48 is conical shaped as depicted in FIGS. 2 & 3, but other shapes may be used, if desired.

Use of the profile 48 is preferred over use of a spring (such as a torsion spring encircling the pivot 36, etc.) to bias the closure member 34 toward its closed position. This is due to the fact that use of springs to displace large diameter flappers has been problematic in prior valves. However, a spring could be used in the isolation valve 14, as an alternative to (or in addition to) the profile 48, without departing from the principles of this disclosure.

It may now be fully appreciated that the above disclosure provides several advancements to the art of constructing and utilizing isolation valves in subterranean wells. The example isolation valve 14 described above is straightforward and reliable in operation, with relatively few moving parts, yet it conveniently provides the advantage of selectively permitting and preventing flow in both directions through the passage 38 when closed.

In particular, the above disclosure provides to the art an isolation valve 14 for use in a subterranean well. The isolation valve 14 can include a pivot 36 connecting a closure member 34 to an actuator member 32 which displaces when the isolation valve 14 is actuated between open and closed configurations. The pivot 36 preferably displaces with the actuator member 32.

The isolation valve 14 can also include a profile 48 formed therein. The profile 48 biases the closure member 34 from an open position to a closed position when the isolation valve 14 is actuated from the open configuration to the closed configuration.

The closure member 34 may comprise a flapper which pivots about the pivot 36 when the isolation valve 14 is actuated between the open and closed configurations.

In the closed configuration, the closure member 34 can be sealingly engaged with a first seat 44 on one side of the closure member, and the closure member 34 can be sealingly engaged with a second seat 46 on an opposite side of the closure member. The first seat 44 may be carried on the actuator member 32.

In the closed configuration, the closure member 34 may prevent fluid flow through a passage 38 extending longitudinally through the isolation valve 14, with the closure member 34 preventing the fluid flow in first and second opposite longitudinal directions through the passage 38.

Also described by the above disclosure is an isolation valve 14 which can include a pivot 36 connecting a closure member 34 to an actuator member 32 which displaces when the isolation valve 14 is actuated between open and closed configurations. A profile 48 may be formed in the isolation valve 14. The profile 48 may bias the closure member 34 from an open position to a closed position when the isolation valve 14 is actuated from the open configuration to the closed configuration.

The above disclosure also describes a method of actuating an isolation valve 14 in a subterranean well. The method can include actuating the isolation valve 14 between open and closed configurations, wherein actuating the isolation valve 14 comprises simultaneously displacing an actuator member 32, a closure member 34, and a pivot 36 which pivotably connects the closure member to the actuator member.

The method may also include interconnecting the isolation valve 14 in a tubular string 16, the tubular string being installed in the well.

Actuating the isolation valve 14 can include a profile 48 formed in the isolation valve biasing the closure member 34 from an open position to a closed position when the isolation valve 14 is actuated from the open configuration to the closed configuration.

The closure member 34 may comprise a flapper which pivots about the pivot 36 when the isolation valve 14 is actuated between the open and closed configurations.

The method can also include sealingly engaging the closure member 34 with a first seat 44 on one side of the closure member, and sealingly engaging the closure member 34 with a second seat 46 on an opposite side of the closure member.

Actuating the isolation valve 14 may include carrying the first seat 44 on the actuator member 32.

The method can include the closure member 34 preventing fluid flow through a passage 38 extending longitudinally through the isolation valve 14 in the closed configuration, and the closure member 34 preventing the fluid flow in first and second opposite longitudinal directions through the passage 38.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower,"

"downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. An isolation valve for use in a subterranean well, the isolation valve comprising:

an actuator member which displaces when the isolation valve is actuated between open and closed configurations;

a closure member;

a pivot connecting the closure member to the actuator member, wherein the pivot displaces with the actuator member; and first and second annular seats, wherein, in the closed configuration, the closure member is sealingly engaged with the first annular seat on a first side of the closure member, and the closure member is sealingly engaged with the second annular seat on a second side of the closure member opposite the first side.

2. The isolation valve of claim 1, further comprising a profile formed in the isolation valve, and wherein the profile biases the closure member from an open position to a closed position when the isolation valve is actuated from the open configuration to the closed configuration.

3. The isolation valve of claim 1, wherein the closure member comprises a flapper which pivots about the pivot when the isolation valve is actuated between the open and closed configurations.

4. The isolation valve of claim 1, wherein the first annular seat is carried on the actuator member.

5. The isolation valve of claim 1, wherein, in the closed configuration, the closure member prevents fluid flow through a passage extending longitudinally through the isolation valve, the closure member preventing the fluid flow in first and second opposite longitudinal directions through the passage.

6. An isolation valve for use in a subterranean well, the isolation valve comprising:

a pivot connecting a closure member to an actuator member which displaces when the isolation valve is actuated between open and closed configurations;

a profile formed in the isolation valve, the profile biasing the closure member from an open position to a closed position when the isolation valve is actuated from the open configuration to the closed configuration; and wherein, in the closed configuration, the closure member is sealingly engaged with a first circumferential seat on a first side of the closure member, and the closure member is sealingly engaged with a second circumferential seat on a second side of the closure member opposite the first side.

7. The isolation valve of claim 6, wherein the pivot displaces with the actuator member when the isolation valve is actuated between the open and closed configurations.

8. The isolation valve of claim 6, wherein the closure member comprises a flapper which pivots about the pivot when the isolation valve is actuated between the open and closed configurations.

9. The isolation valve of claim 6, wherein the first circumferential seat is carried on the actuator member.

10. The isolation valve of claim 6, wherein, in the closed configuration, the closure member prevents fluid flow through a passage extending longitudinally through the isolation valve, the closure member preventing the fluid flow in first and second opposite longitudinal directions through the passage.

11. A method of actuating an isolation valve in a subterranean well, the method comprising:

during actuation of the isolation valve between open and closed configurations, simultaneously displacing an actuator member, a closure member, and a pivot which pivotably connects the closure member to the actuator member; and during actuation of the isolation valve from the open configuration to the closed configuration, sealingly engaging the closure member with a first annular seat on a first side of the closure member, and sealingly engaging the closure member with a second annular seat on a second side of the closure member opposite the first side.

12. The method of claim 11, further comprising interconnecting the isolation valve in a tubular string, the tubular string being installed in the well.

13. The method of claim 11, wherein a profile formed in the isolation valve biases the closure member from an open position to a closed position when the isolation valve is actuated from the open configuration to the closed configuration.

14. The method of claim 11, wherein the closure member comprises a flapper which pivots about the pivot when the isolation valve is actuated between the open and closed configurations.

15. The method of claim 11, wherein the first annular seat is carried on the actuator member.

16. The method of claim 11, further comprising the closure member preventing fluid flow through a passage extending longitudinally through the isolation valve in the closed configuration, and the closure member preventing the fluid flow in first and second opposite longitudinal directions through the passage.

* * * * *